US012196447B2

(12) United States Patent
Wuenstel, Jr.

(10) Patent No.: US 12,196,447 B2
(45) Date of Patent: Jan. 14, 2025

(54) RESERVOIR AND PUMP SYSTEM

(71) Applicant: HELPFUL INNOVATIONS LLC, Odessa, FL (US)

(72) Inventor: Tom E. Wuenstel, Jr., Odessa, FL (US)

(73) Assignee: Helpful Innovations, LLC, Odessa, FL (US)

( * ) Notice: Subject to any disclaimer, the term of this patent is extended or adjusted under 35 U.S.C. 154(b) by 0 days.

(21) Appl. No.: 18/323,511

(22) Filed: May 25, 2023

(65) Prior Publication Data

US 2024/0393006 A1 Nov. 28, 2024

(51) Int. Cl.
*F25D 21/14* (2006.01)
*F24F 13/22* (2006.01)

(52) U.S. Cl.
CPC ..... *F24F 13/222* (2013.01); *F25D 21/14* (2013.01); *F25D 2321/1442* (2013.01)

(58) Field of Classification Search
CPC . F25D 21/14; F25D 2321/1442; F24F 13/222
See application file for complete search history.

(56) References Cited

U.S. PATENT DOCUMENTS 2,304,411 A * 12/1942 Keighley ..... F25D 23/003 62/289
3,316,845 A * 5/1967 Schumann ..... F04D 13/086 417/40
3,758,236 A * 9/1973 Zimmerman ..... F04D 29/426 417/360
5,074,119 A * 12/1991 Anderson ..... B01D 5/009 62/285
6,042,342 A * 3/2000 Orian ..... F04F 1/06 417/208

(Continued)

FOREIGN PATENT DOCUMENTS

CN 2421518 Y * 2/2001
CN 106730509 B * 12/2017

OTHER PUBLICATIONS

Machine translation of CN application (Year: 2001).*

*Primary Examiner* — Filip Zec
(74) *Attorney, Agent, or Firm* — Shumaker, Loop & Kendrick, LLP; S. Alexander Long, Jr.; Brian D. MacDonald

(57) ABSTRACT

A water conservation system includes an air conditioner and a storage tank. The air conditioner has a thermostat, compressor, condenser, expansion valve, evaporator coils, and a condensation line ending in a termination line a distance away from the air conditioner, allowing condensation to exit the air conditioner. The storage tank is located near the termination line in order to capture and hold the condensation being expelled out of the air conditioner through the termination line. The storage tank has an interior void for holding and storing the condensed water. The interior void also houses a submersible pump having a motor, check valve, power supply, float switch, and discharge pipe. Condensation flows from the air conditioner condensation line, out the termination line, and into the storage tank via a selectively closeable funnel. The condensation is then selectively removable from the storage tank by actuating the power supply of the submersible pump.

7 Claims, 7 Drawing Sheets

(56) References Cited

U.S. PATENT DOCUMENTS 6,059,143 A * 5/2000 Weir ..... A45F 3/00 222/61
6,322,326 B1 * 11/2001 Davis ..... F24F 13/222 417/279
6,341,944 B1 * 1/2002 Butcher ..... F04D 15/0218 417/40
6,474,351 B1 * 11/2002 Cerruti ..... A47L 15/4409 68/17 R
6,565,325 B2 * 5/2003 Belehradek ..... F04D 15/0218 417/40
6,592,333 B1 * 7/2003 Magallanes ..... F24F 13/222 310/179
7,127,943 B1 * 10/2006 Griffiths ..... G01F 23/265 73/304 C
7,150,190 B2 * 12/2006 Krufka ..... G01F 23/266 73/304 C
7,252,482 B2 * 8/2007 Walker ..... F04D 13/06 417/40
7,264,449 B1 * 9/2007 Harned ..... F04D 15/0218 417/366
7,820,995 B2 * 10/2010 Gadini ..... G01F 23/292 250/576
7,972,117 B1 * 7/2011 MacDonald ..... F04B 49/025 417/40
8,602,744 B2 * 12/2013 Ward ..... F04D 15/0218 417/36
9,958,182 B1 * 5/2018 Rimmer ..... F24F 13/222
10,125,894 B2 * 11/2018 Ji ..... E03C 1/10
10,415,228 B2 * 9/2019 Irving ..... E03F 5/107
11,674,715 B2 * 6/2023 Kim ..... F24F 7/06 62/291
11,680,730 B2 * 6/2023 Forshaw ..... F04B 53/003 417/363
2002/0157465 A1 * 10/2002 Marioni ..... G01F 23/265 340/623
2002/0176782 A1 * 11/2002 Batchelder ..... F04D 15/0236 417/18
2005/0207902 A1 * 9/2005 Bonifacio ..... F04F 5/48 417/182.5
2007/0151277 A1 * 7/2007 Pothier ..... F28D 5/00 62/305
2010/0269953 A1 * 10/2010 Lucas ..... F41B 9/0071 222/79
2016/0060850 A1 * 3/2016 Johnson ..... E03B 11/06 137/565.17
2020/0017387 A1 * 1/2020 Canello ..... C02F 3/006
2021/0222895 A1 * 7/2021 Bae ..... F24F 1/0087

* cited by examiner

RESERVOIR AND PUMP SYSTEM

TECHNICAL FIELD

The present disclosure relates to apparatuses, systems, and methods for a reservoir and pump system. More particularly, the present disclosure relates to a reservoir and pump system for the collection and containment of condensation and other water runoff from an air conditioner.

BACKGROUND

Air conditioners, or AC units remove heat from an enclosed space in order to cool the air while also removing humidity from the space. An air conditioning system may also provide heating and ventilation. The typical AC system involves a vapor-compression refrigeration process that is achieved by using forced circulation and phase change of a refrigerant between gas and liquid to transfer heat. In its most simplest form, the refrigeration cycle includes a condensing coil, an expansion valve, an evaporator coil, and a compressor. AC units draw in heat and moisture from the air to cool the air and reduce humidity. During this process, the humidity is turned into condensation. A pipe and drainage system assists with draining the condensation produced during the AC cycle. Most condensate drain lines utilize gravity to assist in the drainage of the excess condensation; however, pumps may also be included to expedite drainage. However, while there are codes and regulations on where it is permitted to dump condensate, there is a lack of water conservation in this field. For example, a typical condensate drain and disposal system regulation requires that the condensate not discharge into a street, alley, or other areas so as to cause a nuisance. There are even additional requirements for handling condensate overflow. While a single AC unit may produce up to 25 gallons a day, and even more on hotter and more humid days, that water simply goes to waste.

Therefore, improvements are needed for AC system condensation collection that reduces water waste, stores the water for later use, and provides a system for using the stored water.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

According to at least one embodiment, a reservoir and pump system includes an air conditioner having a condensation line that ends in a termination line a distance away from the air condition. The system further includes a reservoir located proximate the termination line and configured to hold and store a volume of liquid received from the air conditioner, wherein the reservoir includes: (1) a submersible pump, the submersible pump having a motor, a check valve, a power supply, a vertical float switch, and a discharge pipe having a first end and a second end; and (2) a spigot coupled to the second end of the discharge pipe. When the condensed water flows or is expelled from the air conditioner, it travels through the condensation line, out of the termination line, and into the reservoir. The condensed water is selectively removable from the reservoir when the power supply of the submersible pump is actuated.

In example embodiments, a reservoir includes an interior void formed by a bottom surface, a top surface, and four sidewalls. The reservoir further includes a submersible pump disposed within the interior void, the submersible pump having a motor, a check valve, a power supply, a vertical float switch, and a discharge pipe. The top surface of the reservoir has a first aperture configured to allow condensed water from an air conditioner to enter the interior void of the reservoir, a second aperture configured to allow the discharge pipe to extend through the top surface, and a third aperture configured to allow a portion of the power supply to extend through the top surface.

In at least one embodiment, a storage tank and pump system is disclosed, wherein the storage tank and pump system includes an air conditioner and a storage tank. The air conditioner includes: (1) a thermostat configured for sensing temperature of air in an area or space surrounding the air condition; (2) a compressor configured for compressing a refrigerant from a low-pressure gas into a high-pressure gas; (3) condenser coils configured for receiving the high pressure gas refrigerant from the compressor, where the condenser coils condense the high pressure gas refrigerant into a high pressure liquid state by removing heat from the refrigerant; (4) an expansion valve configured for receiving the high pressure liquid refrigerant, wherein the expansion valve is configured for restricting flow of the liquid refrigerant and lowering the liquid refrigerant pressure; (5) evaporator coils configured for receiving the low pressure refrigerant liquid from the condenser coils, wherein the evaporator coils are configured for absorbing heat from the air and causing condensation to form; and (6) a condensation line that ends in a termination line a distance away from the air conditioner to allow the condensation to exit the air conditioner. The storage tank is located proximate the termination line and configured to hold and store a volume of liquid received from the air conditioner. The storage tank has a submersible pump having a motor, a check valve, a power supply, a vertical float switch, and a discharge pipe. The tank further includes a pipe having a first end coupled to the discharge pipe and a second end coupled to a spigot. The condensation flows from the air conditioner condensation line, out of the termination line, and into the storage tank. The condensation is selectively removable from the storage tank when the power supply of the submersible pump is actuated.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate some, but not all, embodiments and features as briefly described below. The summary and detailed descriptions, however, are not limited to only those embodiments and features explicitly illustrated.

DETAILED DESCRIPTIONS

Figure 1:
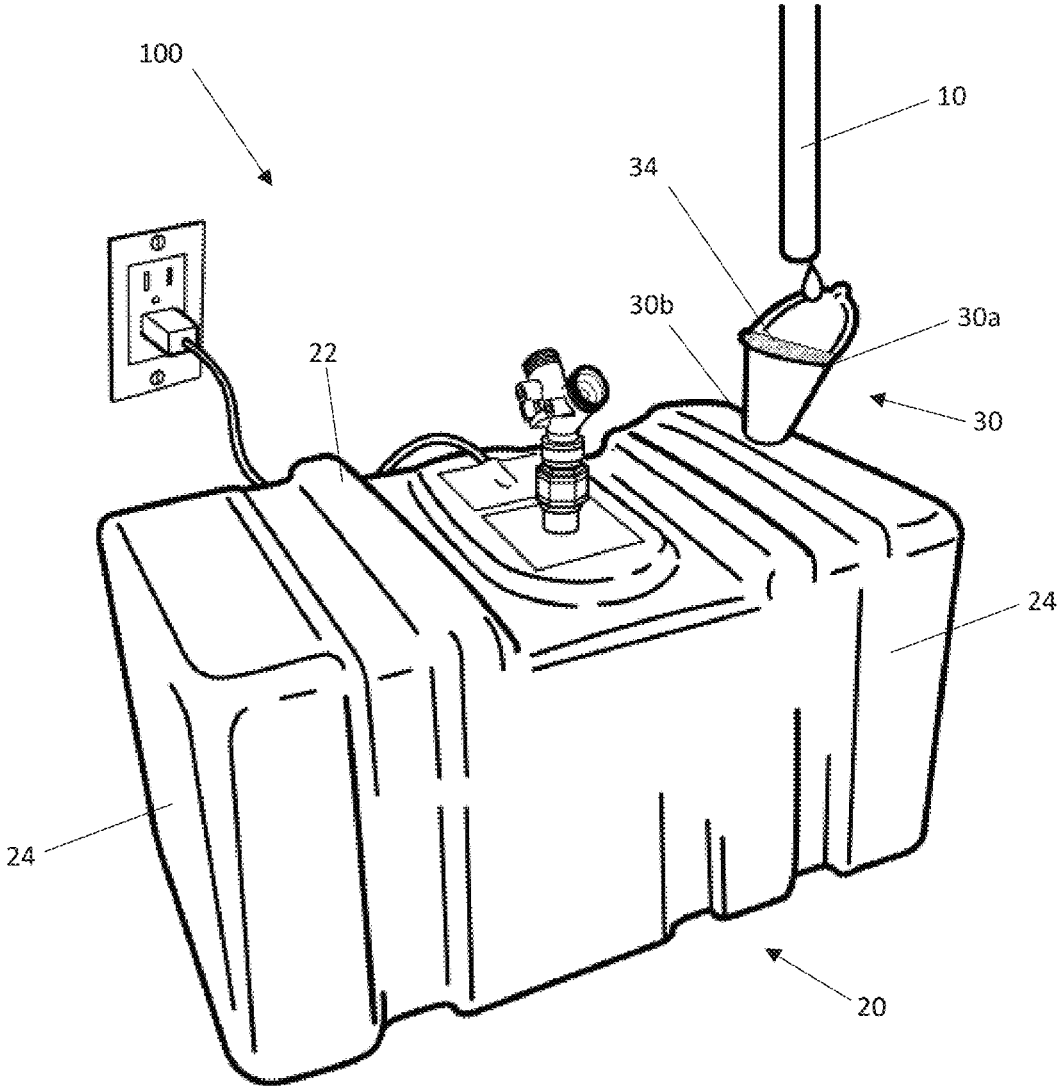
FIG. 1 is a perspective view of a reservoir and pump system according to at least one embodiment.
Figure 2:
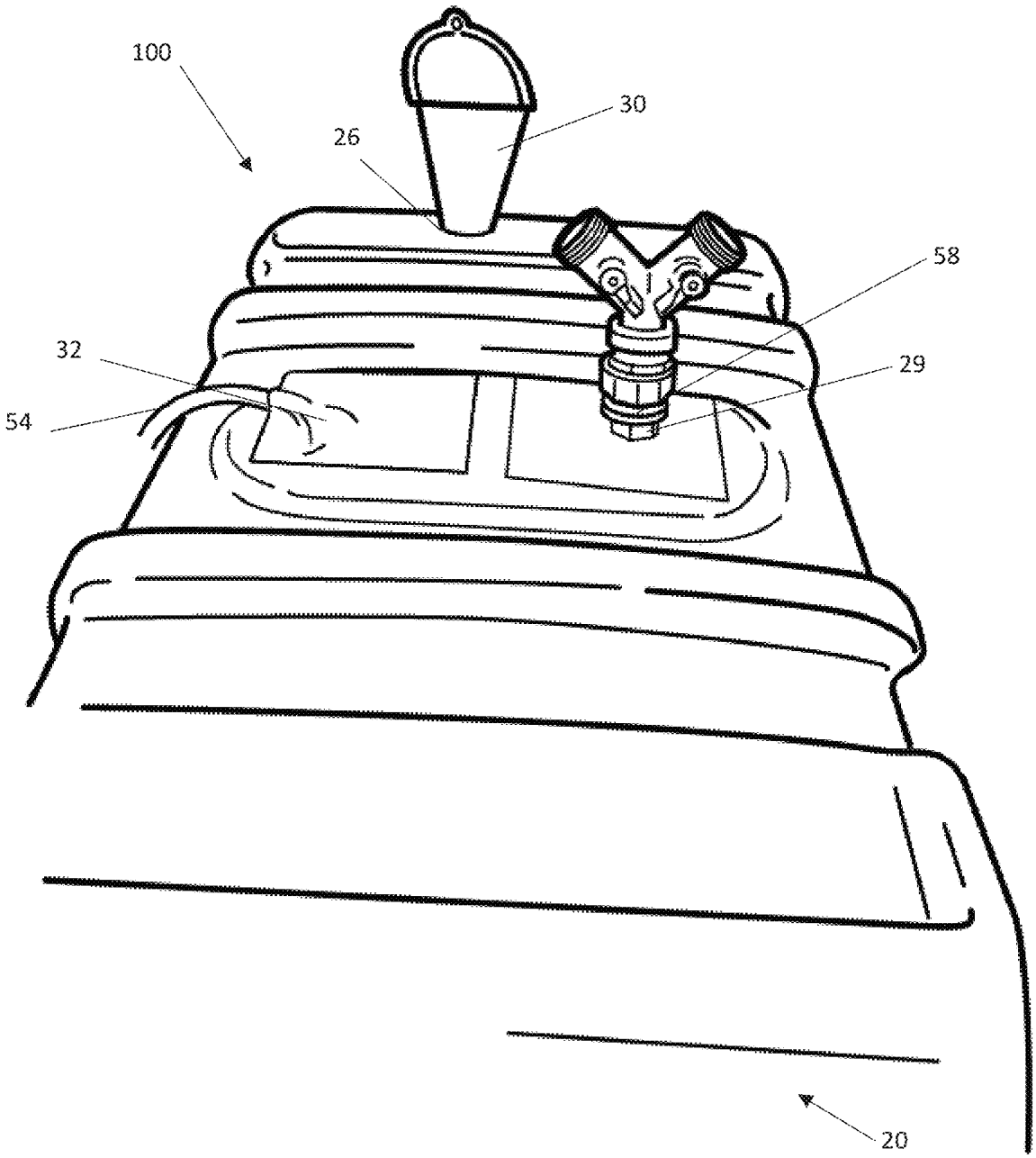
FIG. 2 is a partial perspective view of the reservoir and pump system of FIG. 1.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Unless defined otherwise, technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a," "an," and "the" refer to "one or more" when used in the subject specification, including the claims. Unless indicated to the contrary, the numerical parameters set forth in the instant specification and attached claims are approximations that can vary depending upon the desired properties sought to be obtained within the scope of these descriptions.

An reservoir and pump system 100, according to at least one embodiment, is shown in FIGS. 1-7. The reservoir and pump system generally includes an air conditioner (not shown or numbered), or AC unit, a reservoir or storage tank 20, and a submersible pump 50. The AC unit may be any suitable AC unit that may be used to remove heat from an enclosed space and to control humidity. The AC unit generally includes a thermostat, a compressor, condenser coils, an expansion valve, evaporator coils, and a condensation line. In particular embodiments, the condensation line terminates at a termination line at a distance away from the air conditioner.

The AC unit components and functions are comparable to a typical air conditioning system. For example, the AC unit includes a thermostat that senses the temperature of the air in the surrounding area and controls the operation of the air conditioner based on the desired temperature settings. A compressor plays a vital role in the refrigeration cycle. It compresses the low-pressure gas refrigerant, typically in a gaseous state, into a high-pressure gas. Condenser coils receive the high-pressure gas refrigerant from the compressor. In addition, the condenser coils remove heat from the refrigerant, causing it to condense into a high-pressure liquid state. The heat extracted from the refrigerant is usually expelled to the outdoor environment. An expansion valve is responsible for receiving the high-pressure liquid refrigerant from the condenser coils. Its function is to restrict the flow of the liquid refrigerant, which results in a drop in pressure. This pressure drop is necessary for the refrigerant to evaporate and absorb heat in the evaporator coils. Subsequently, the evaporator coils receive the low-pressure refrigerant liquid from the expansion valve. As is typical, the evaporator coils are located inside the indoor unit of the air conditioner and are responsible for absorbing heat from the air in the surrounding area. As the refrigerant absorbs heat, it evaporates into a low-pressure gas. A condensation line then collects the condensed water vapor formed on the evaporator coils as a result of the cooling process, which in turn allow the condensation to exit the air conditioner. A termination line 10 is the endpoint of the condensation line and is located a distance away from the air conditioner. The termination line 10 serves as an outlet for the condensation to be safely disposed of, preventing water damage to the unit and surrounding areas. Overall, the AC unit system follows the basic principles of refrigeration and air conditioning, using the compressor, condenser, expansion valve, and evaporator coils to cool and dehumidify the air in the surrounding area.

As shown in FIGS. 1-5, a reservoir or storage tank 20 is located proximate the termination line 10 of the AC unit. The storage tank 20 is sized and configured to hold and store a volume of liquid received from the air conditioner. In example embodiments, the storage tank 20 is configured to hold a volume of liquid between about five and 25 gallons, more preferably about 10 to 20 gallons, for example, about 12.5 gallons. While shown as generally rectangular in shape, having a top surface 22, a bottom surface (not shown or numbered), and four sidewalls 24, the storage tank 20 may be any suitable shape or size. For example, in alternate embodiments, the storage tank may include a round barrel having a removable or selectively closeable lid.

Figure 5:
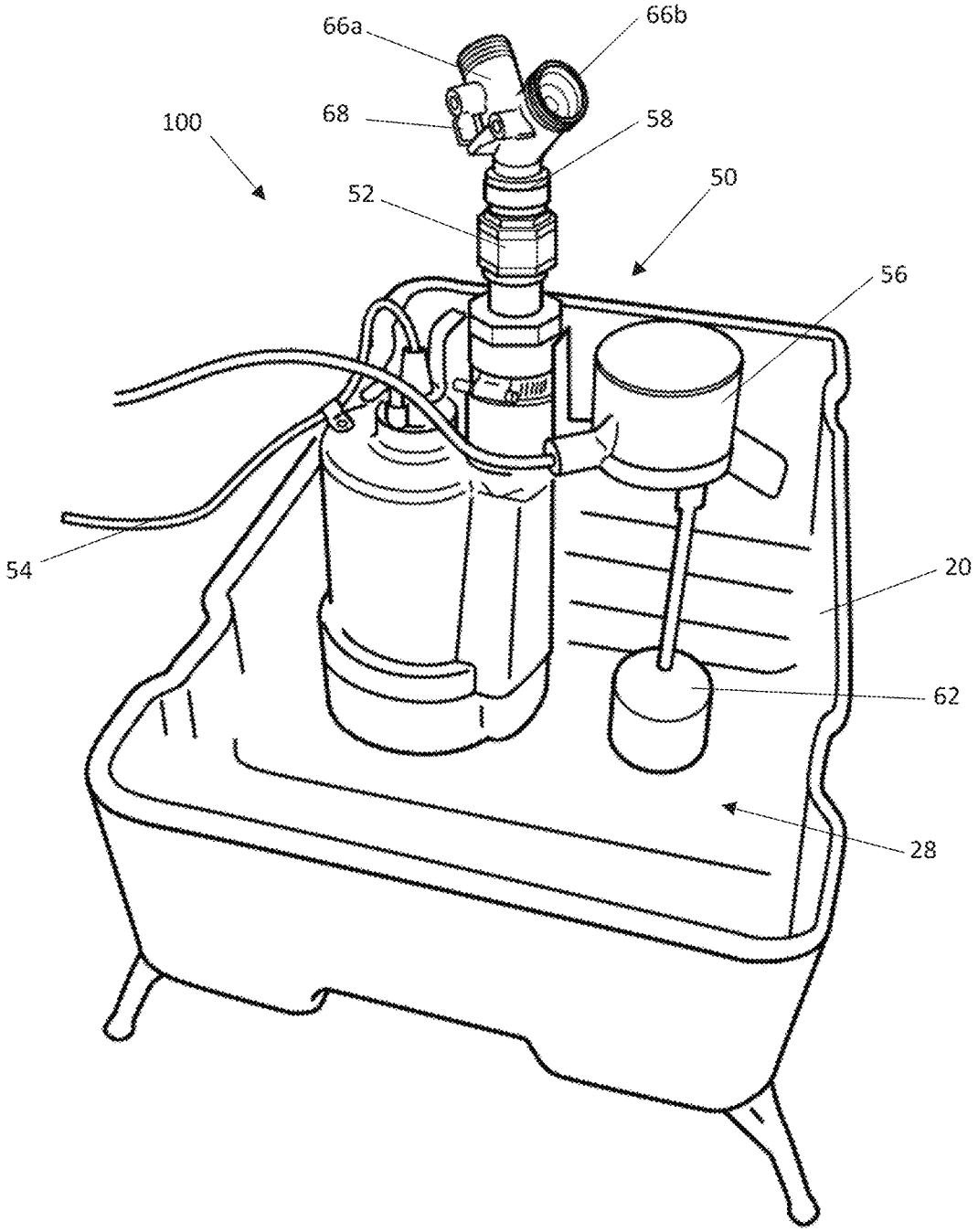
FIG. 5 is a perspective view of the interior of the reservoir and pump system of FIG. 1.

In particular embodiments, the top surface 22 includes a first aperture 26 for allowing the condensed water from the termination line to enter the interior void 28, as depicted in FIG. 5. The top surface 22 further includes a second aperture 29 for allowing a portion of the submersible pump 58 to extend through the top surface, as discussed further below. Finally, a third aperture 32 in the top surface 22 is configured to allow a portion of the power supply 54 to be accessible from the exterior of the storage tank 20.

Figure 3:
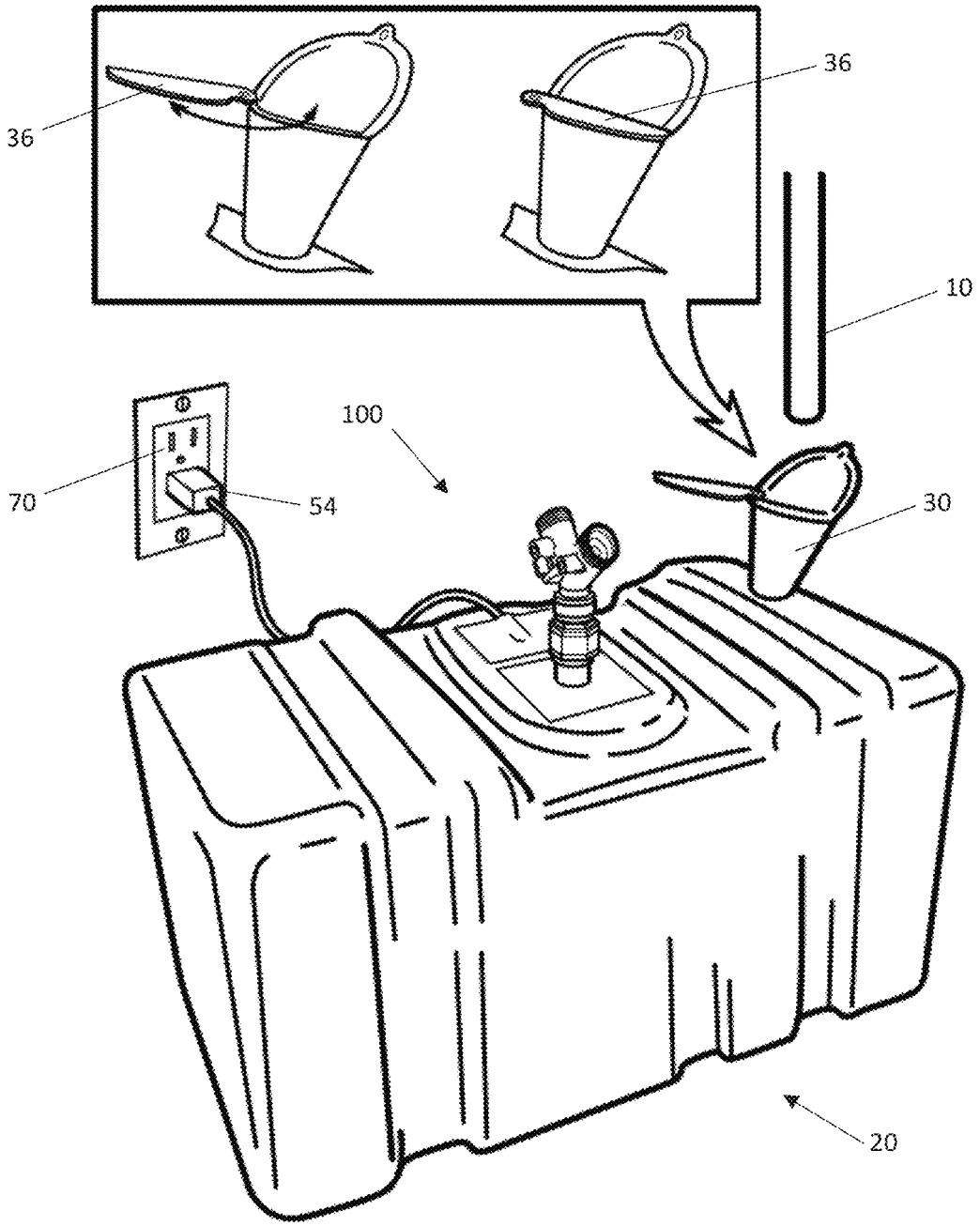
FIG. 3 is an expanded perspective view of the funnel of the reservoir and pump system of FIG. 1.
Figure 4:
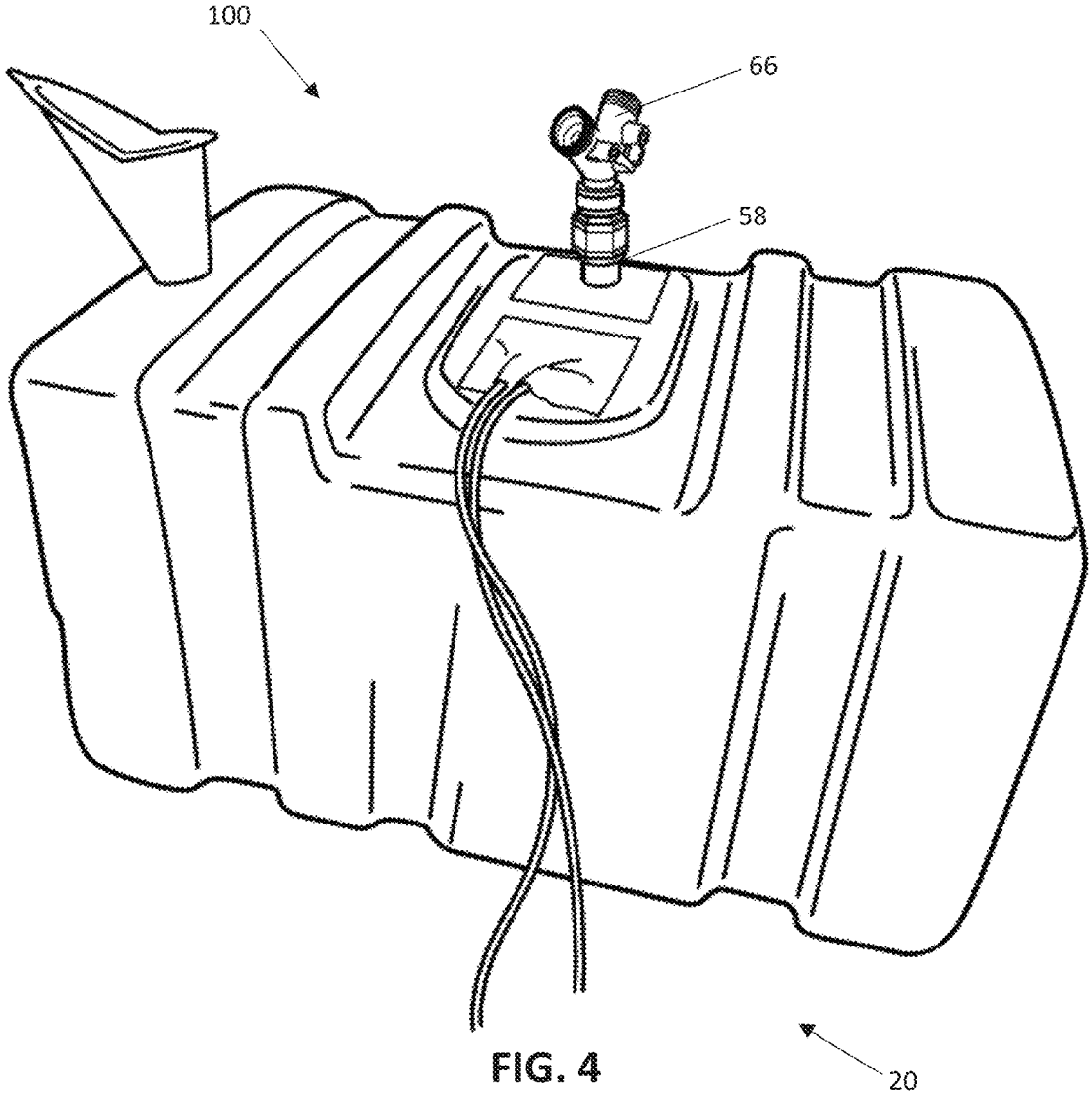
FIG. 4 is a rear perspective view of the reservoir and pump system of FIG. 1.

In example embodiments, the first aperture 26 is sized and shaped for receiving a funnel 30 in order to capture the most condensation possible from the termination line 10 of the AC unit. In particular embodiments, as shown in FIG. 1, the funnel 30 includes a first, wide mouth opening 30*a* and a second, narrower opening 30*b* extending through the storage tank top surface 22. A mesh screen or similar device 34 may be coupled to the first opening 30*a* to prevent debris and other unwanted particles from entering the storage tank 20. In some embodiments, the funnel 30 may further include a selectively closeable cap or lid 36, as shown in FIG. 3. For example, the selectively closeable device may include a removable cap, a sliding cap, or a pivoting cap or lid. This selectively closeable device is beneficial when the air conditioner needs servicing or cleaning, such as with vinegar, and a user wishes to keep the resulting drainage from entering the storage tank.

In example embodiments, the storage tank 20 is formed from any suitable material (e.g., stainless steel, plastic, polymer, metal, composite material, and/or the like) and made using molding or other conventional techniques and equipment (e.g., extrusion molding, injection molded, blow molded, compression molding, rotational molding, thermoforming, 3D printing, casting, etc.). In example embodiments, the storage tank 20 is constructed of a sturdy, durable material that is able to withstand various types of environmental elements and conditions. In example embodiments, the storage tank 20 may include one or more handles or wheels (not shown) for moving or adjusting the position of the storage tank. For example, where it is desired to use the water collected by the storage tank for gardening, one or more wheels may be used to transport the storage tank from one area of the garden to the next. The one or more handles or wheels may also be helpful where the collected water is intended to be deposited into a larger holding tank, for example, for lawn irrigation. In particularly hot environments, the stored water may be routed to an irrigation system for the home or building's foundation to prevent cracking. The water may also be beneficial for water collection that is later filtered for drinking, bathing, or other potable water needs.

Figure 6:
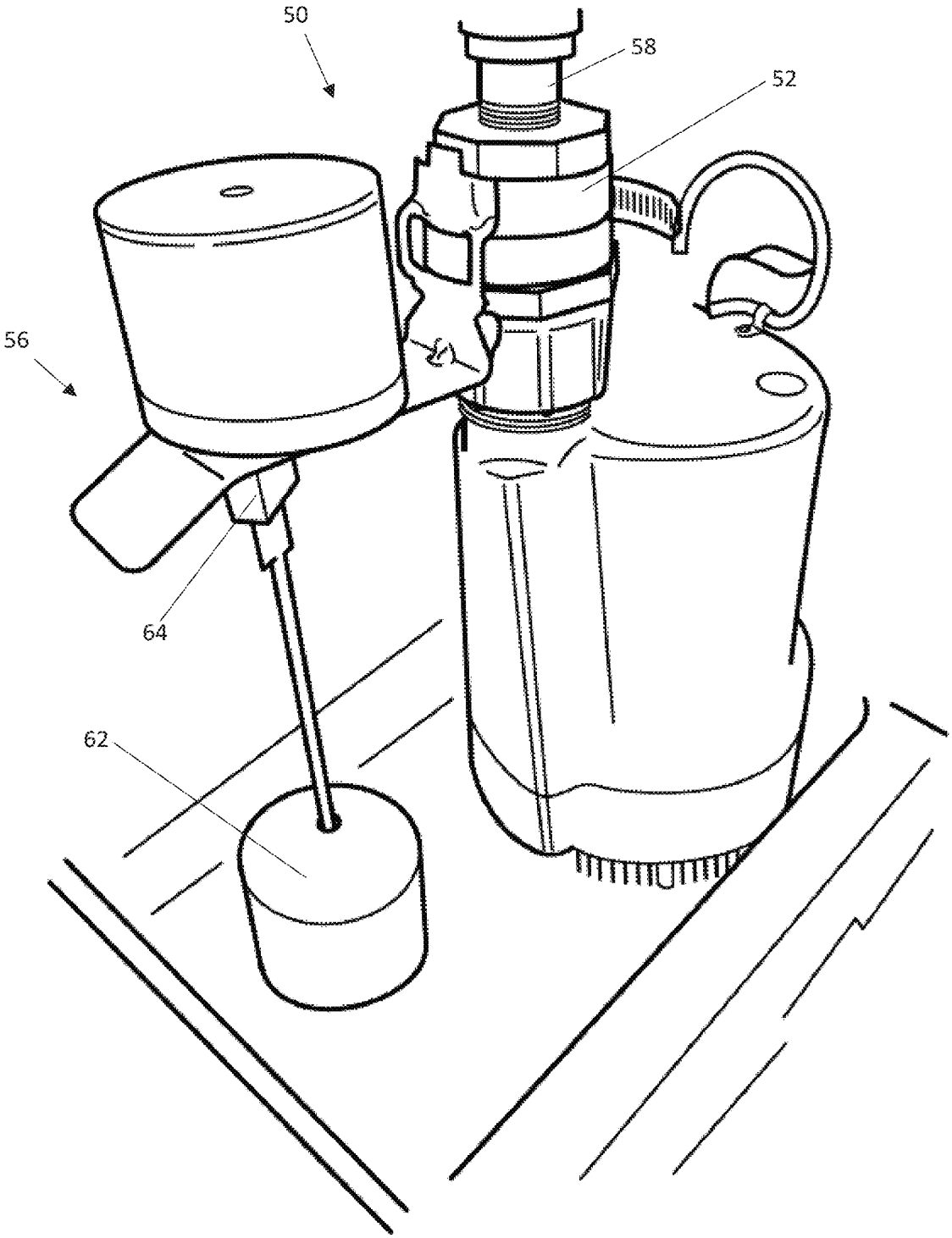
FIG. 6 is a perspective view of the pump of the reservoir and pump system of FIG. 1.

Referring now to FIGS. 5-6, the reservoir and pump system 100 includes a submersible pump 50. While described as a submersible pump, it is understood that this description is not limited to submersible pumps and any suitable water pump may be utilized including, but not limited to, submersible sump pump, pedestal sump pumps, battery back-up sump pumps, sprinkler pumps, pool pumps, or any other suitable water pump.

In example embodiments, the submersible pump 50 includes a motor (housed within the pump), a check valve 52, a power supply 54, a vertical float switch 56, and a discharge pipe 58. The submersible pump 50 may be used to remove the water that has been collected and stored by the storage tank 20. Thus, the water may enter the pump 50 through a suction inlet or similar opening and exit the pump through the discharge pipe 58 when the pump is actuated, or turned on. The pump 50 is equipped with a float switch 56 that activates the pump when the later level reaches a particular height. The water may then be expelled through the discharge pipe.

The check valve or backflow preventer 52 is installed in the discharge pipe 58 of the submersible pump and helps to ensure the efficient and effective operation of the pump. The check valve 52 is designed to allow water to flow in only one direction to prevent backflow of the water back into the storage tank once it has been pumped out. When the pump 50 is actively pumping out the water, the water pushes against the check valve 52, opening it and allowing the water to flow out through the discharge pipe 58. When the pump is in the OFF state, the check valve automatically closes, preventing any water from flowing back into the pump. In particular embodiments, the check valve 52 is formed from any suitable, durable material such as PVC, ABS, or metal.

Figure 7:
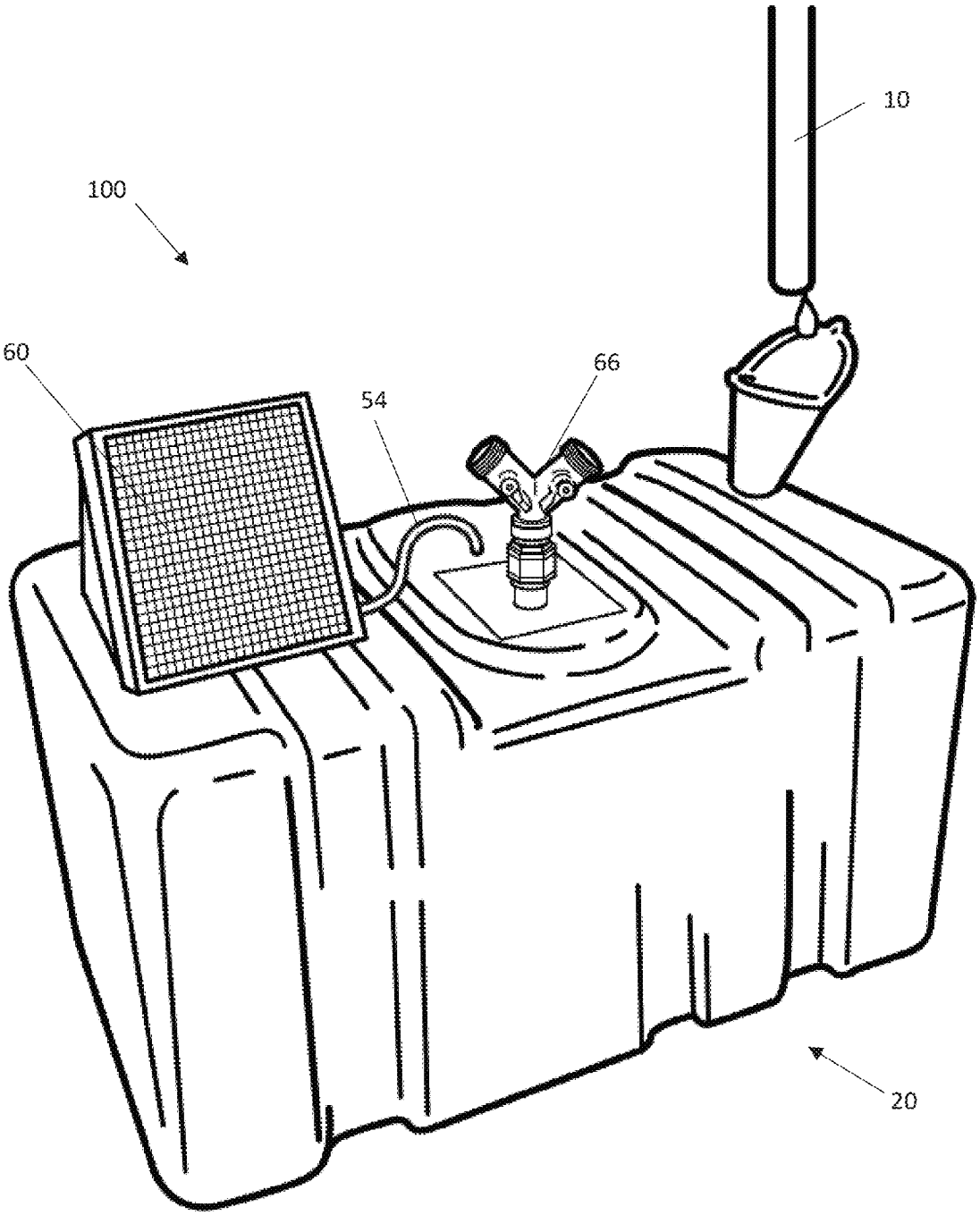
FIG. 7 is a perspective view of the reservoir and pump system of FIG. 1, according to various embodiments having a solar panel power supply.

The submersible pump 50 includes a power supply 54 that may be coupled to a power source 70 for providing electricity to the pump. Any suitable power supply may be used to supply electricity to the pump. In example embodiments, the power supply may be an AC power supply, a DC power supply, or a solar power supply. In some embodiments, the pump 50 may be powered by a direct electrical connection by hardwiring the pump directly to an electrical circuit. In embodiments where the storage tank will need to be transported, the pump 50 may include a power supply having a plug for connecting to an existing electrical outlet. In particular embodiments, the pump 50 may also include a battery backup system in case of power outages. A backup power supply, such as an uninterruptible power supply, can be connected to the pump and may kick in during any power outages. In alternate embodiments, as shown in FIG. 7, the pump 50 may be powered by solar energy through the use of solar panels 60 and a solar power system. In example embodiments utilizing solar power, the system includes one or more solar panels, a charge controller, battery storage, and an inverter.

The float switch 56, while described as a vertical float switch, may be any suitable float switch including a tethered float switch. In example embodiments, the float switch is used to detect the level of liquid or water in the storage tank 20. The float switch 56 includes a buoyant float 62 attached to a switch mechanism 64. As the liquid level rises or falls, the float 62 also moves up or down accordingly. When the water reaches a particular level, the float 62 triggers the switch 64, either by physically moving it or through magnetic or electrical signals. The float switch 56 is useful in controlling the pump system by allowing a user to switch between an ON state and an OFF state. In various embodiments, the switch may be any suitable switch including a toggle switch, rocker switch, pus-button switch, rotary switch, etc.

The discharge pipe 58 has a first end coupled to the pump 50 and a second end that extends through the top surface 22 of the storage tank to the exterior of the storage tank. In particular embodiments, a spigot or valve 66 is coupled to the second end of the discharge pipe 58. The discharge pipe 58 is generally constructed from a rigid material such as PVC, or any other suitable material that can handle the flow of water and resist corrosion. In example embodiments, the pipe 58 is coupled to the second end or discharge end of the discharge pipe and coupled to a spigot 66. In particular embodiments, the spigot 66 may include a Y-shaped splitter having a first arm 66*a* with a first opening and a second arm 66*b* having a second opening. When the condensed water is pumped through the discharge pipe 58 to the spigot 66, the condensed water may flow out of at least one of the first opening and the second opening. In particular embodiments, each arm of the Y-shaped splitter includes a valve shut off 68 for diverting the water between either the first arm or the second arm, or entirely preventing the water from exiting the system. Thus, the first and second valve shut offs 68 allow for single or dual flow of the water. In some embodiments, the spigot 66 includes a backflow preventer device. In various embodiments, the spigot may be coupled to a typical garden hose or other accessory for directing or aiming the flow of the water. In some embodiments, the installed pump 50 is capable of running two 25 foot soaker hoses simultaneously.

When the power supply 54 of the pump 50 is activated, the condensed water is pumped from the storage tank 20, though the discharge pipe 58, and out the spigot 66. Thus, the water is selectively removable from the reservoir 20 when the power supply 54 is actuated.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A system comprising:

an air conditioner having a condensation line that ends in a termination line a distance away from the air conditioner;

a reservoir and pump system located proximate the termination line and configured to receive a volume of liquid received from the air conditioner via the termination line, wherein the reservoir and pump system comprises:

a storage tank comprising a top surface, four sidewalls connected to the top surface, and a bottom surface connected to the four sidewalls and top surfaced via the four sidewalls;

multiple legs connected to and together supporting the storage tank;

a submersible pump within the storage tank and supported by the bottom surface of the storage tank, the submersible pump comprising a motor, a check valve, a vertical float switch, and a power supply comprising a solar panel and at least one of an AC power supply and a DC power supply;

a discharge pipe having a first end coupled to the submersible pump and a second end that extends through the top surface of the storage tank to the exterior of the storage tank;

a funnel at least partially received by a first aperture defined in the top surface of the storage tank, the funnel comprising a first mouth opening outward from the top surface of the storage tank and a second mouth extending through the top surface of the storage tank, the second mouth being more narrow than the first mouth;

a cap pivotally mounted on the funnel, the cap having an open position at which the volume of liquid received from the air conditioner via the termination line is received via the funnel and a closed position, the cap being pivotable relative to the funnel between the open position and closed position without movement of the funnel relative to the storage tank;

a spigot comprising a conduit coupled to the second end of the discharge pipe above the top surface of the storage tank, a first arm connected to the conduit and a second arm connected to the conduit, wherein:

the conduit, first arm, and second arm together define a Y-shaped splitter;

the first arm comprises a first opening and a first valve between the conduit and first opening; and the second arm comprises a second opening and a second valve between the conduit and second opening; and wherein the liquid received from the air conditioner via the termination line flows into the storage tank via the funnel with the cap in the open position, and wherein the liquid is selectively removable from the storage tank via the discharge pipe and spigot when the power supply of the submersible pump is actuated and at least one of the first valve and the second valve are opened.

2. The system of claim 1, wherein the top surface comprises a second aperture being configured to allow the discharge pipe to extend through the top surface, and a third aperture being configured to allow a portion of the power supply to extend through the top surface.

3. The system of claim 1, wherein the funnel comprises a screen configured to help prevent debris from entering the reservoir.

4. The system of claim 1, wherein, when the power supply of the submersible pump is actuated:

at least some of the liquid flows from the storage tank through the first arm of the spigot when the first valve is open; and at least some of the liquid flows from the storage tank through the second arm of the spigot when the second valve is open.

5. The system of claim 1, wherein the spigot comprises a second check valve configured to prevent backflow.

6. The system of claim 1, wherein the reservoir is configured to store a volume of liquid between approximately 5 gallons and 20 gallons.

7. A system comprising:

an air conditioner comprising:

a thermostat configured for sensing temperature of air in an area surrounding the air conditioner;

a compressor configured for compressing a refrigerant from a low-pressure gas into a high-pressure gas;

condenser coils configured for receiving the high pressure gas refrigerant from the compressor, wherein the condenser coils condense the high pressure gas refrigerant into a high pressure liquid state by removing heat from the refrigerant;

an expansion valve configured for receiving the high pressure liquid refrigerant, wherein the expansion valve is configured for restricting flow of the liquid refrigerant and lowering the liquid refrigerant pressure;

evaporator coils configured for receiving the low pressure refrigerant liquid from the condenser coils, wherein the evaporator coils are configured for absorbing heat from the air and causing condensation to form liquid; and a condensation line that ends in a termination line a distance away from the air conditioner to allow the liquid to exit the air conditioner;

a storage tank located proximate the termination line and configured to hold and store a volume of liquid received from the air conditioner via the termination line, wherein the storage tank comprises a top surface, four sidewalls connected to the top surface, and a bottom surface connected to the four sidewalls and top surfaced via the four sidewalls;

multiple legs connected to and together supporting the storage tank;

a submersible pump located within the storage tank and supported by the bottom surface of the storage tank, the submersible pump comprising a motor, a check valve, a vertical float switch, and a power supply comprising a solar panel and at least one of an AC power supply and a DC power supply;

a discharge pipe having a first end coupled to the submersible pump and a second end that extends through the top surface of the storage tank to the exterior of the storage tank:

a funnel at least partially received by a first aperture defined in the top surface of the storage tank, the funnel comprising a first mouth opening outward from the top surface of the storage tank and a second mouth extending through the top surface of the storage tank, the second mouth being more narrow than the first mouth;

a cap pivotally mounted on the funnel, the cap having an open position at which the volume of liquid received from the air conditioner via the termination line is received through via the funnel and a closed position, the cap being pivotable relative to the funnel between the open position and closed position without movement of the funnel relative to the storage tank; and a spigot comprising a conduit coupled to the second end of the discharge pipe above the top surface of the storage tank, a first arm connected to the conduit and a second arm connected to the conduit, wherein:

the conduit, first arm, and second arm together define a Y-shaped splitter;

the first arm comprises a first opening and a first valve between the conduit and first opening; and the second arm comprises a second opening and a second valve between the conduit and second opening; and wherein the liquid received from the air conditioner via the termination line flows into the storage tank via the funnel with the cap in the open position, and wherein the liquid is selectively removable from the storage tank via the discharge pipe and spigot when the power supply of the submersible pump is actuated and at least one of the first valve and the second valve are opened.

* * * * *